United States Patent [19]

Svyatsky

[11] Patent Number: 4,891,088

[45] Date of Patent: Jan. 2, 1990

[54] DOCUMENT FORWARDING SYSTEM

[75] Inventor: Eduard Svyatsky, Chicago, Ill.

[73] Assignee: Bell & Howell Company, Chicago, Ill.

[21] Appl. No.: 109,216

[22] Filed: Oct. 16, 1987

[51] Int. Cl.[4] ..... B65H 39/02

[52] U.S. Cl. ..... 156/350; 156/361; 156/362; 156/364; 156/387; 209/900; 271/110; 271/111; 271/31.1; 271/149; 271/150; 364/478

[58] Field of Search ..... 156/350, 387, 384, 542, 156/361, 362, 363, 364; 364/478; 209/900; 271/31.1, 109, 110–111, 126, 129, 149, 150, 237, 250

[56] References Cited

U.S. PATENT DOCUMENTS

| | | | |
|---|---|---|---|
| 3,368,672 | 2/1968 | Heaney et al. | 209/900 X |
| 3,459,420 | 8/1969 | Huntwork | 271/150 |
| 4,576,370 | 3/1986 | Jackson | 156/355 |
| 4,578,759 | 3/1986 | Horii | 364/478 |
| 4,607,833 | 8/1986 | Svyatsky | 209/900 X |
| 4,757,985 | 7/1988 | Hammant | 271/149 X |

*Primary Examiner*—David Simmons

*Attorney, Agent, or Firm*—Laff, Whitesel, Conte & Saret

[57] ABSTRACT

A computer enhanced document forwarding system capable of feeding individual generally flat documents from a horizontally disposed edge stack of documents and include a transporter for accepting serially disposed end to end individual documents one at a time, the transporter sequentially moving each document to at least one station for observation by an operator; electronic information storage facility having an interconnected input and retrieval means positioned adjacent to the operator observation station; a supply of self-adhering labels sequentially disposed in end to end fashion; an electronically controlled printer where the labels pick up ink in a predetermined symbol array capable of being different for each label; and a continuous label applying device for serially applying corrective labels to serially disposed documents with both the labels and documents moving in the same direction, thereby carrying corrective information supplied by said storage means to individual pieces of incorrectly designated documents.

34 Claims, 7 Drawing Sheets

FIG. 2A $V_1 < V_2 < V_3$

FIG. 2B $V_4 = V_5 < V_6$

DOCUMENT FORWARDING SYSTEM

BACKGROUND AND BRIEF DESCRIPTION OF THE INVENTION

This invention relates in general to the handling of mail and, in particular, to an improved forwarding address system for use with mail sorting machines.

The volume of mail handled daily by large businesses, institutions and governmental entities has steadily increased through the years. For example, credit card companies, utilities, mail order houses and other advertisers send and receive huge quantities of mail daily. Typically, the envelopes containing the material to be mailed are addressed and then sorted into common groups for mailing. Similarly, mail received by such entities is commonly sorted into groups based the subject matter of the received material. A third category of such envelopes are the returned mail category the creation of which is primarily due to the addressee having moved from a particular address resulting in the envelope being undeliverable. The present invention is a system directed to the solution of this latter type of problem, namely, the correction of the address by application of a secondary label to the envelope with the correct forwarding address that will permit its proper delivery.

Several different types of machines have been developed to assist in the handling of such mail, other than manual review and correction by the individual mail carrier. These prior art devices typically comprised an envelope feeder, a read station, a selection of label station where a supply of labels permitted selection of an appropriate label and its application to an envelope, and a sorting and storage means.

None of these prior art machines and systems proved satisfactory since they were large unwieldy machines that required not only a large amount of space but also required frequent replenishment of a vast array of preprinted label supplies and applicating equipment.

The present invention provides a unique computer-operator controlled system with a plurality of unique stations that are suitable for use with conventional mail sorting machines.

The contemplated system includes a feeder module having a unique envelope feeder apparatus wherein incoming envelopes are separated from each other and delivered to a transport module. The unique transport module moves the envelope or document to a plurality of read stations that are provided with a single CRT and input keyboard means tied to a main computer data source for use and control by an operator. Observation of indicia by the operator and selective input into the keyboard means results in an electable response by the operator, the elected information then being sent to a unique print module for use in creation of an appropriate corrective label. The envelopes that pass through the read station are serially moved through a unique labeler module that utilizes the serially produced labels emanating from the print module. The corrected envelopes are then sorted in a known sorting machine by use of the same information that controlled the creation of a label in the printer module.

The system further includes a feeder module having means whereby a stack of envelopes or documents are maintained in an upright edgewise orientation and are fanned outwardly from one another to permit movement of individual envelopes, regardless of thickness, into the nip of the shifting rollers located at one end of the feeder module for lateral movement to the next station where the operator is located. By having the feeder module extending perpendicular to the balance of the machine the operator can be positioned adjacent to it and readily handle problems, if any, that might arise at his elbow.

Additionally, ;he system includes a unique transport module having a plurality of stations in each of which the operator has an unobstructed view of the entire front surface of the envelope while reading the address or other identifying data thereon. Once the address or zip code has been read by the operator, the operator makes a codified entry which is processed by the computer, with which the machine is associated, and into which computer the changes of address have been introduced on a frequent periodic basis. If the limited information code introduced by the operator is applicable to more than one individual addressee, alternatives will be displayed to the operator for the operator to choose from. The information so chosen is then forwarded to the next module and the envelope or document released for movement out of the operators visual range serially into the next module.

Another object of the present system is the provision of a unique label printing module that utilizes a dot matrix type print head that moves the material to be printed upon into contact with an ink source in accordance with the impulse information provided by the computer. The labels so produced are then moved to the labeler module which is designed to remove the substrate or backing material from the label and to move the label in the same direction as the movement of the envelopes to enhance the effectiveness of its application to a particular chosen envelope.

A further object of the system is to provide an effective labeler module for rapid application of a ore-printed self-adhesive label to a predetermined envelope or document for which it has been prepared and to effectively and rapidly remove the backing material from said label before its application to the envelope.

Still another object of the invention is to provide a document forwarding system of the type contemplated that includes these improved modules within the system that will reliably operate over extended time parameters with minimal down times, as well as being relatively simple and economical to construct and operate.

Other and further objects of this invention together with all of the features of novelty appurtenant thereto, will appear in the course of the following description.

BRIEF DESCRIPTION OF THE DRAWINGS

FIGS. 2A and 2B are diagrammatic representations of the velocities of various elements utilized in the feeder module;

DETAILED DESCRIPTION OF THE INVENTION

Figure 1:
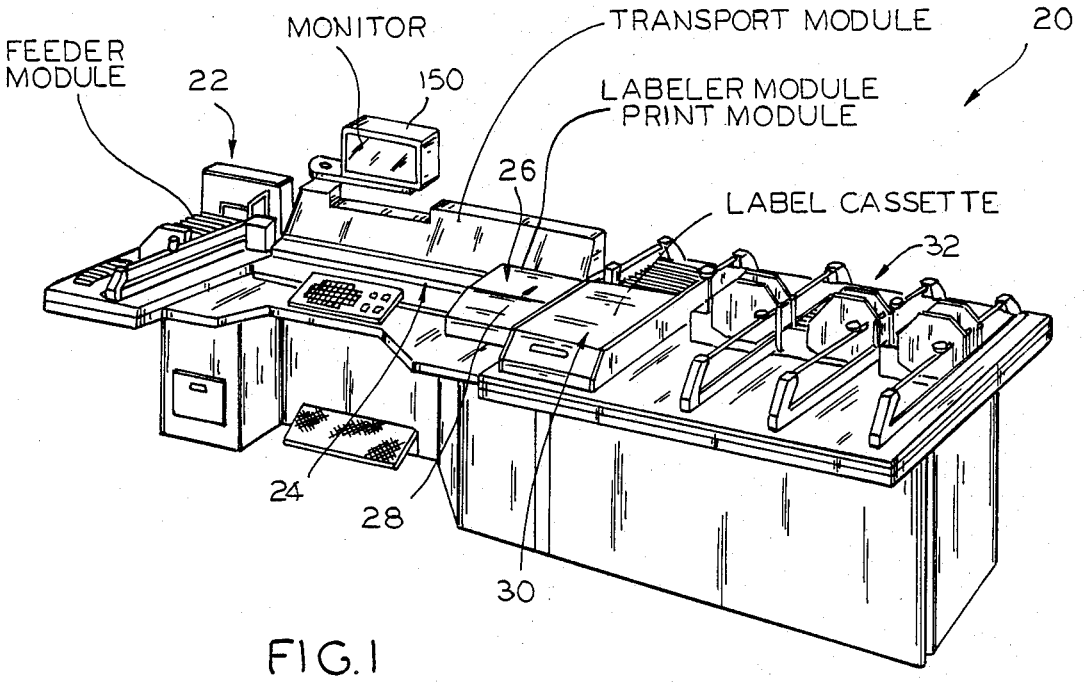
FIG. 1 is a perspective view of an embodiment of the present invention.

Referring now to the drawing, wherein similar parts are designated by similar numerals, a computer assisted document forwarding system of the type contemplated by the present invention, and generally designated by the numeral 20, includes an integrated system of several modules, each of which are interrelated with the other and mutually interdependent. Such forwarding systems are designed to reduce the labor factor involved in updating a mailing list and also to forward mail that has been erroneously deposited at a local post office.

A system of the type contemplated by the present invention would include a feeder module 22, a transport module 24 which has a plurality of observation means stations, a print module 26, a labeler module 28, a label cassette 30, and a sorting and stacking module 32. It is such a system, referred to earlier, that can be used by the local post offices where documents, i.e. mail envelopes of various sizes, have been stopped because a customer has entered a change of address order and hence existing documents are not properly addressed for delivery purposes. It is recognized that there are a broad variety of applications for such a system, other than postal usage, in the catalogue, credit card, mail order/-mail system categories and any others where a billing or form of address means must accommodate changes in address. It provides a ready update system and reduces the labor expenses by providing an accurate, readily available listing of correct addresses for immediate application to a document. The system is basically an ancillary arm to a master computer where all of the address changes are fed and maintained for a predetermined time frame. The information in the master computer is made available to the subsidiary or remote stations for use by an operator to update on a ready basis the address to which particular pieces of mail are to be forwarded.

To broadly describe the operation of the system embodied in such a device, and by no means to be limiting a plurality of documents or envelopes are stacked upright in edge-wise fashion on a feeder module 22 which feeds them sequentially in serial fashion, one at a time to the first of the plurality of observation means stations located in the transport module 24. The operator reads the address of the document and types into the computer an abbreviated version of the address, for example, the first three letters of the addressee's last name and the last two digits of the zip code. The keyboard being the input mechanism into an electronic information storage means interconnected with the input means also serves as a retrieval means to inform the operator. Normally, where there is only one combination of such letters and digits on file, the computer automatically selects the proper address. If there are more than one possible responses to the input they all are provided to the operator, for example, they can be visually displayed on a cathode ray tube (CRT). The operator then selects the correct one and continues the operation by striking an appropriate key. The document is then fed to a buffer station on the transport module 24 where it remains while a label is printed in the print module 26 from the selected data fed to it by the computer. The document is then released from the buffer station and transported to the labeler module 28 where the previously printed label with the correct address information for the particular addressee is applied to the document. It is then moved through and to the sorter and stacker, which movement can also be controlled on the basis of the same data fed from the computer to the printer so that it is immediately broadly sorted for delivery to the correct address.

Figure 3:
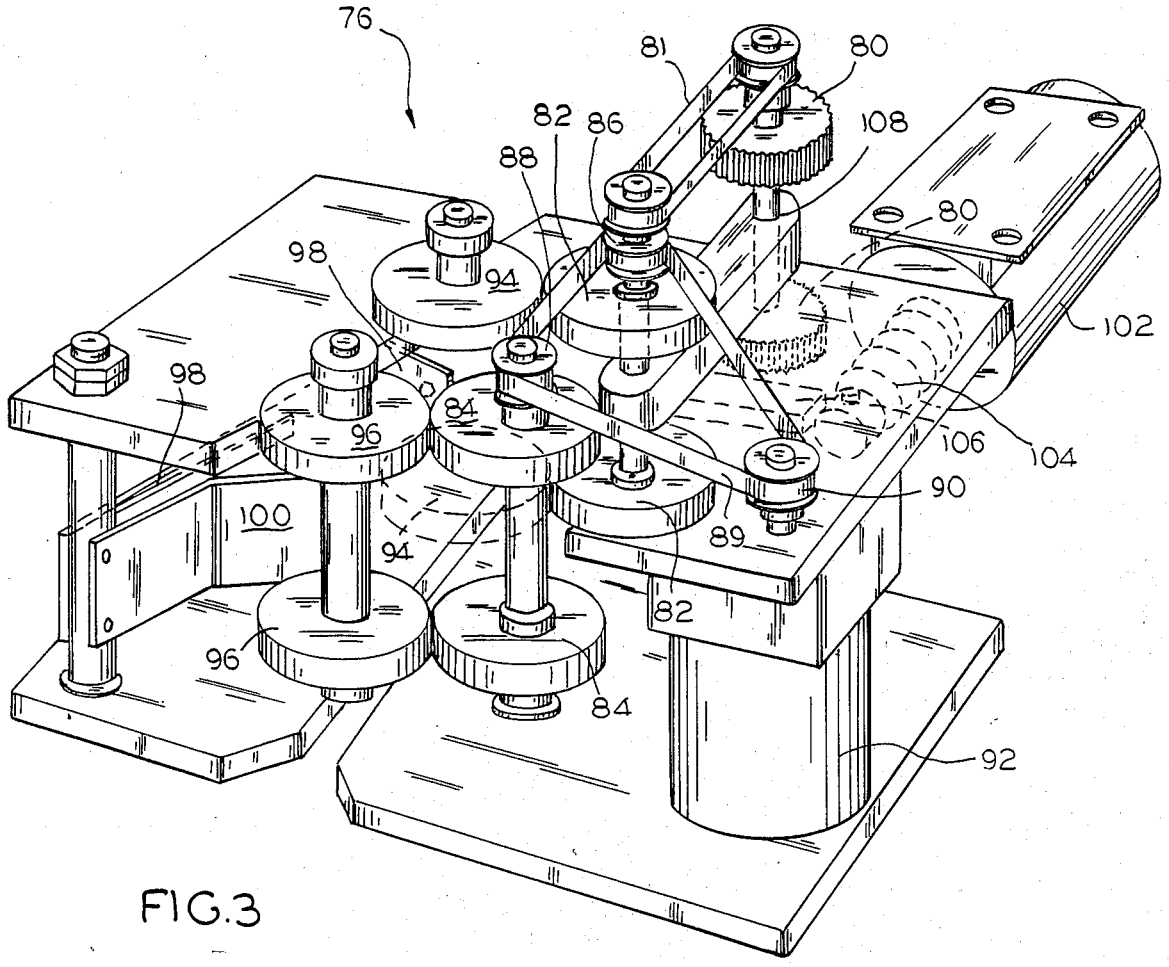
FIG. 3 is a partial perspective view of the drive means utilized at one extremity of the feeder module for movement of documents/envelopes to the transport module.
Figure 2:
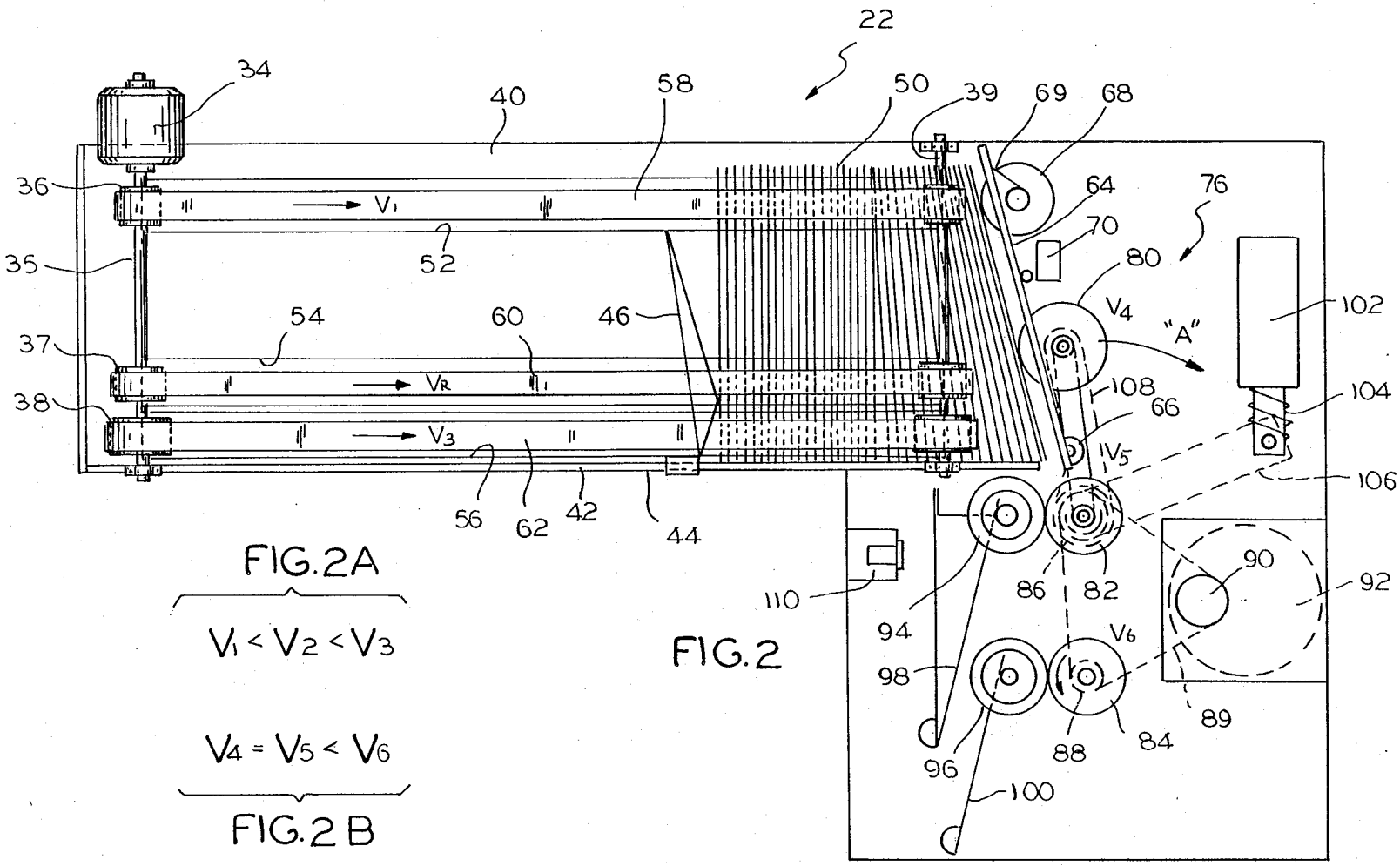
FIG. 2 is a plan view of the feeder module having the protective hood shown in FIG. 1 removed for clarity.

Referring now to FIGS. 1 through 3, and particularly FIG. 2. the feeder module 22 includes an elongated planar base 40, which is shown as being transparent in FIG. 2 for ease in observation of the mechanisms located below the base. The transparency is not a necessity in practical operation. Along one edge there is provided an abutment or wall 42 carrying a slide or track means 44. Means 44 is adapted to accept a spring loaded back plate 46 for purposes of moving a stack 50 of envelopes standing upright on their elongated edges from one end of the base 40 to the other end.

To assist in the movement of the stack 50, the base 40 includes a plurality of spaced parallel slots. In this embodiment the slots are three in number and are indicated as 52, 54, and 56. A plurality of belt-like members 58, 60 and 62 are disposed respectively in slots 52, 54 and 56 and project slightly above the plane of base 40. Each of the belt-like members in operation has a different rate of linear speed relative to each other. In the preferred embodiment the spaced movable means, or belts each have a relatively progressive increase in velocity as measured transversely from one edge of the base to the opposite edge. As seen in FIG. 2, the length of the arrows v1, v2, and v3 indicate the relative velocities of these belt-like members. A single power source in the form of motor 34 is provided with an elongated shaft 35 having a plurality of spaced driving drums 36, 37 and 38 with differing diameters and positioned in an ever increasing order of size along the shaft 35. In this fashion a constant speed motor 34 will provide the belts with differing velocities due to the linear speed developed as the belts 58–62 pass over the differing sizes of driving drums 36, 37 and 38. The opposite ends of the belts are supported on idler pulleys mounted on shaft 39 that is maintained in position by pillow blocks at its opposite ends. FIG. 2A discloses algebraically the relationship of the velocities of the belts in progressive increasing order as measured across the planar base 40.

When documents that are standing on their edge on the base 40 are moved forward by the differing velocities of these belts, and assisted by the back plate 46, the end of the document edge contiguous to the belt having the highest velocity will tend to fan away from the stack and present one end canted and spaced from the stack for easy separation therefrom by suitable means such as a feeder wheel to move the document out of the stack and into the transporter module.

As the stack is moved along the base 40, to the right as viewed in FIG. 2 the stack 50 will confront a plate-like member 64 that is pivoted at one end as at 66. The plate 64 is spring loaded about pivot 66 and carries at its other end, opposite pivot 66, a rotatable wheel means 68 spring loaded by spring 69 to confront and provide ease in movement of the first envelope in the stack 50. When the plate 64 is confronted by excessive pressure from the stack the plate will rotate clockwise, as viewed in FIG. 2, about the pivot 66 and will engage switch means 70. When switch 70 is activated by the pivoted plate 64 it puts out a signal that stops motor 34 and the feeding motion of the belts until the excessive pressure is relieved by removal of documents from the stack whereupon switch 70 is deactivated and the motor turned back on.

Also located at the right hand end of base 40 is a feeder mechanism 76 having a plurality of pairs of spaced wheel means mounted on common shafts for gripping the envelopes at spaced vertical locations to provide a smooth unskewed movement of the envelopes serially from the feeder module to the transport module. The first pair of such wheels are the feed wheel means 80 which are adapted to extend through suitable slot means in the plate 64 to thereby permit engagement of the feed wheel means 80 with the first envelope in the stack. The illustrated serrated condition of wheels 80 are for purposes of providing increased friction or is representative of a decreased durometer in the wheels 80 so that they bite and can insure movement of the first envelope in the stack when contacted by the wheels 80. The feed wheel means 80 are mounted on a common shaft carried by a movable arm 108 which permits the feed wheel means to move in and out of engagement with the first document on the stack for purposes set forth hereinafter.

When the feed wheels 80 engage the document it is moved into position in the nip between the first pair of driven rollers 82 and spring loaded back-up rollers 94. This first double pair of rollers are adapted to move the first document laterally away from the stack when the feed wheels 80 initiate envelope movement toward the nip of the first driven rollers 82. The feeder module 76 then presents a second pair of vertically spaced driven rollers 84 opposed by spring loaded back-up rollers 96 in juxtaposed movable opposition thereto and with the second pair of driven rollers being generally aligned with the first pair of driven rollers but spaced laterally therefrom and having a higher speed than the first pair of driven rollers. This is accomplished by having a common power source in the form of a motor 92 having a pulley 90 on its power shaft carrying a common belt 89 for driving rollers 82 and 84. The pulley engages and passes over pulley 86 (connected to first rollers 82) with pulley 86 having an override clutch means integrally built therein and with pulley 86 having a first predetermined diameter. The belt 89 then continues over a smaller diameter pulley 88 (driving rollers 84) with the belt 89 driving rollers 84 at a higher speed than rollers 82 due to the constant linear movement of the belt 89 and the difference in the diametrical measurement of the two pulleys. Thus, with the driven rollers 84 moving at a higher speed than rollers 82 the document will be pulled from engagement with rollers 82 (overriding the clutch in pulley 86) and moved into the transport module as will be explained hereafter. The facing or back-up rollers 94 and 96 are maintained in movable engaging positions with the respective driven rollers by means of the springs 98 and 100.

The presence or absence of an envelope between the driven rollers 82 and 84 is detected by suitable means 110 i.e. an electric eye photocell or an infra red detector, or any other suitable detection means. The presence of an envelope in that position activates the solenoid 102 which through its spring loaded power arm 104 causes another connected arm 106 that is fixedly connected to arm 108 to move the feeder wheels 80 in the direction of arrow A, as seen in FIGS. 2 and 3. In this fashion the feeder wheel 80 is disengaged and prevented from delivering another envelope out of the stack 50. When the blocking document clears the detection means the power is de-energized and the feed wheel means then moves in a direction opposite to arrow A into engagement with the next document.

It will be noted that a common belt 81 is used to drive the pulleys which connect the feed wheels 80 and the first pair of rollers 82, said pulleys being of the same size. Therefore, the velocities, as best seen in algebraic symbolism in FIG. 2B, of the feed wheels 80 and the first set of rollers 82 are designated Velocity 4 and Velocity 5 and are equal, but both are less than the velocity of the next pair of rollers 84. Rollers 84, as was previously noted, are driven by pulley 88 having a smaller diameter than the pulley 86 to thereby provide a faster linear speed and which will literally pull an envelope out of the nip between the rollers 82 and the idler wheels 94 by permissive slippage of the overriding clutch in pulley 86.

While the feeding mechanism contemplated above is described in detail to display its relationship as a module within the system of the present invention, it should be noted that specific coverage for such feed mechanism is covered in a co-pending application filed concurrently with this present application, Ser. No. 07/109,714, filed 10/16/87.

Figure 4:
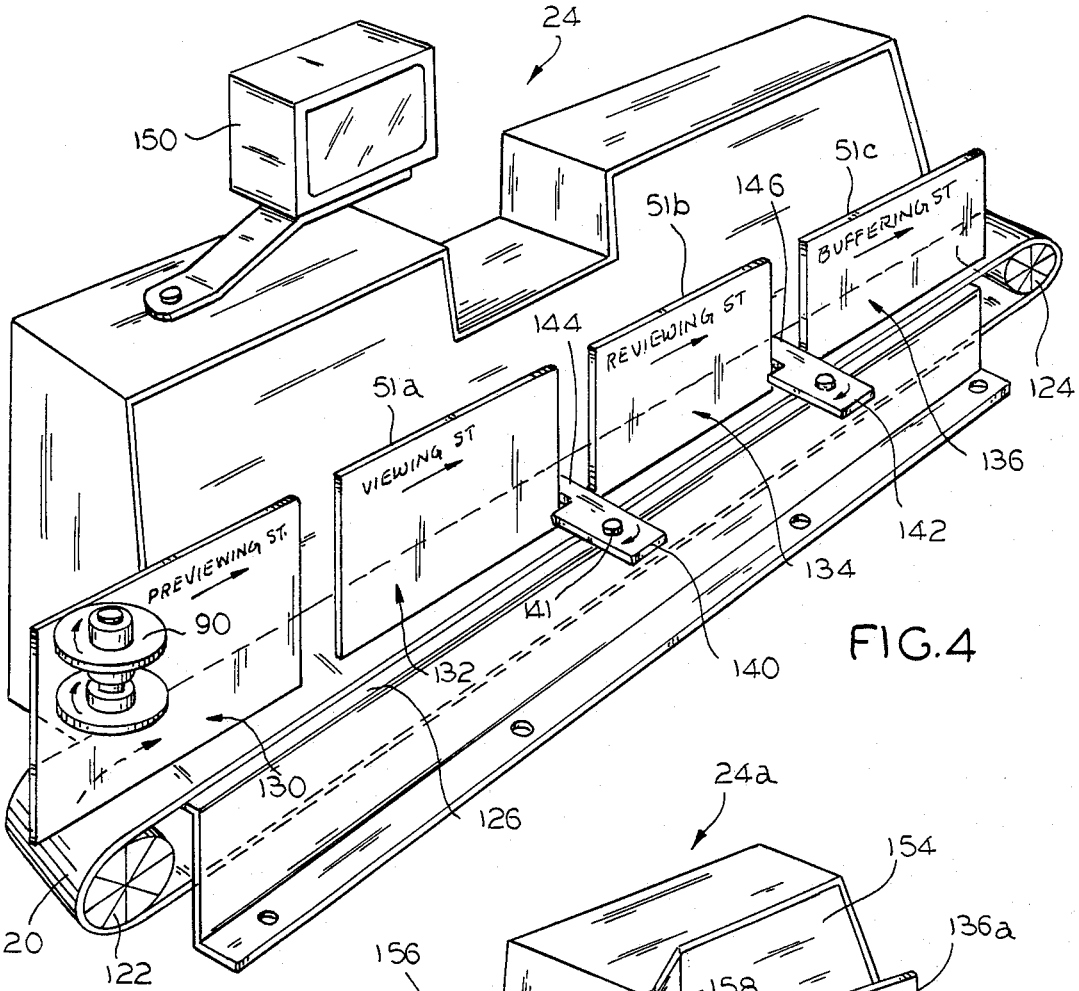
FIG. 4 is a perspective view in partial section of a preferred embodiment of the transport module showing the various viewing stations thereon.

Referring now to FIG. 4, the transport module 24 includes a plurality of viewing stations disposed on a generally vertically disposed panel member, canted slightly to the rearward, and extending upwardly from a desk-like operator station. These viewing stations provide the operator a full view of the broad front or address side of the envelope for reading and correcting purposes. As the envelope 51 comes out of engagement with the last double pair of rollers 84 and 96 (only wheels 96 being shown in FIG. 4) the envelope 51 engages and transfers to a moving belt 120 riding on rollers 122 and 124. The belt is supported by a lubricious frame member 126. The envelope 51 is shown in the first or previewing station 130; the envelope **51*a* is shown in the viewing station 132 where the envelope 51*a* abuts and is temporarily restrained against movement with the belt 120 by the stop 140. The serially next preceding envelope 51*b* is positioned in the reviewing station 134 where the envelope is held in a temporarily restrained configuration by the stop 142. The last station in the transport module is a buffering or holding station 136 illustrated by envelope designated 51*c***. (The indicated names and arrows are purely for purposes of illustration only and are not meant to be limiting.)

As the envelopes 51 proceed across in front of the operator, the operator reads the address and the name of the addressee in the previewing station and in the viewing station. In the viewing station 132, the operator types the coded information into a computer keyboard terminal, not shown in this figure, which information is fed into the computer having the corrected information. After typing in the last digit of the code and viewing it on the monitor 150, the program in the computer causes the stop means 140 and 142 to be simultaneously activated and rotated about pivots 141 and 14, respectively, which causes the fingers 144 and 146 to be moved out of the way and permit envelope 51*a* to move with the belt 120 into the position of 51*b*; and similarly envelope 51*b* to move into the buffering station, as shown with envelope 51*c*. Activation of the stop means 140 and 142 can be equated to that of a pair of simultaneously opening gates that permit those items on the moving belt to be passed to the next station.

When an envelope 51*a* moves to the reviewing station 134 the operator will look at the monitor 150 to determine whether there is a possibility of a multiple choice from the code typed in at station 132. If this exists, the operator will make the necessary selection to correspond to the remainder of the information that had not been fed into the computer with the abbreviated code. Selection of one of the choices will then be made and the envelope passed on to the buffering station 136. It should be noted that the envelope 51*c* will be retained in the buffering station 136 until the printing operation has been completed and the label ready to be applied to envelope 51*c*. Needless to say, the stop 142 would not be activated until buffering station 136 has been cleared and available to accept the next envelope.

Figure 5:
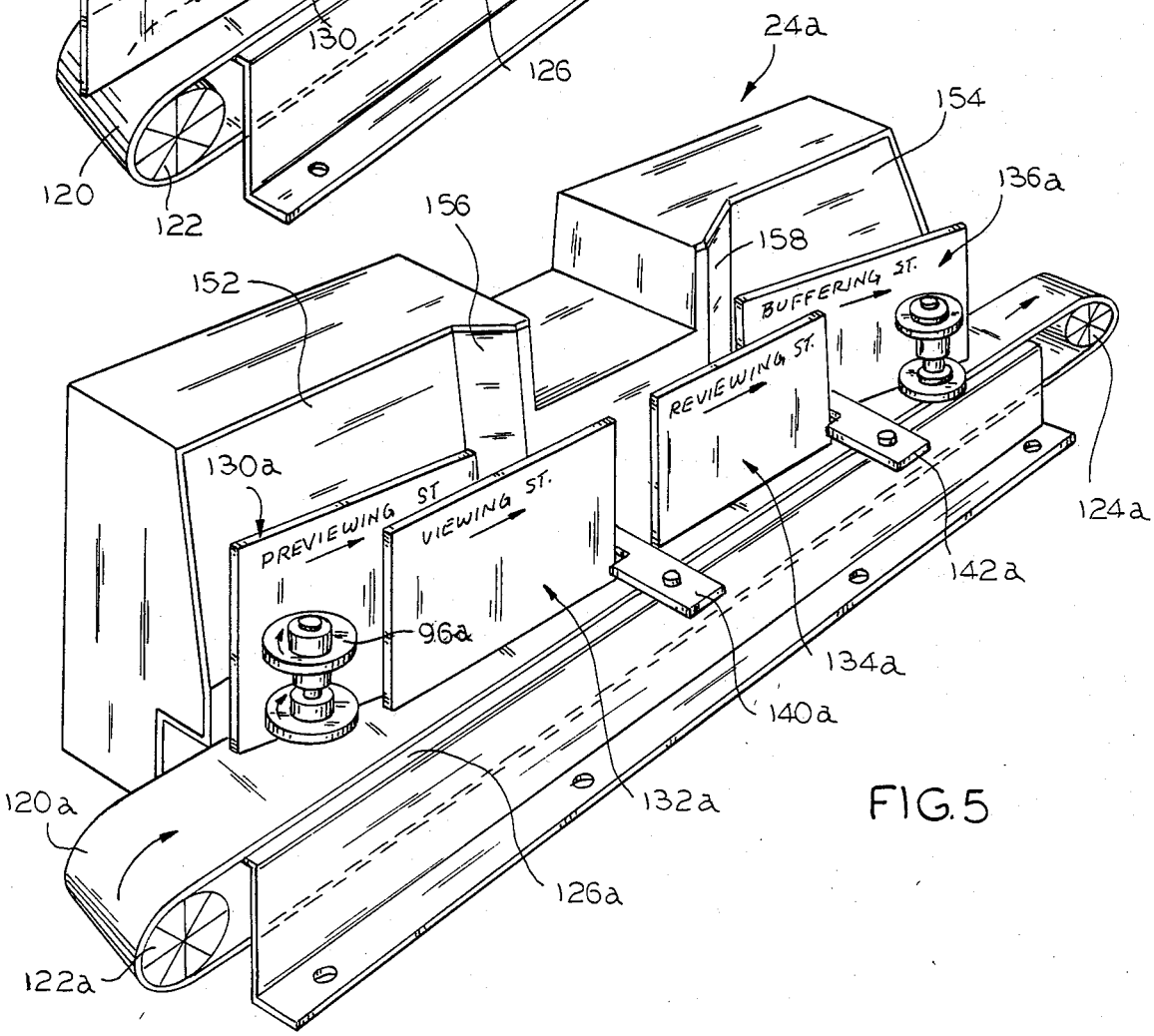
FIG. 5 is a perspective view in partial section of a second embodiment of the transport module.
Figure 6:
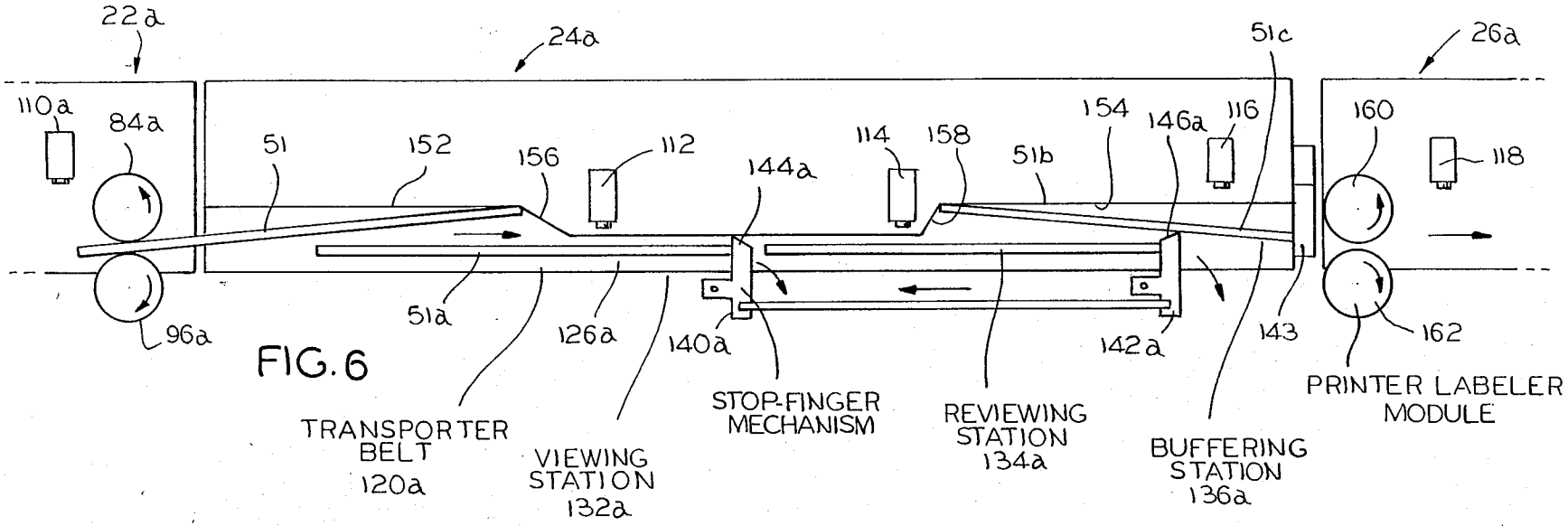
FIG. 6 is a schematic plan view of the transport module shown in FIG. 5.

Referring now to FIGS. 5 and 6, wherein similar parts are designated by similar numerals with the addition of the suffix "a", a second embodiment of the transport module 24*a* utilizes a foreshortened or shingled configuration. The module 24*a* includes the same four stations, namely, previewing, viewing, reviewing and buffering stations. However, the module includes a central portion 150 which lies in a plane that is positioned forwardly of the plane of the two adjoining first and third portions 152 and 154, respectively. The first portion 152 and the third portion 154 are connected to the central portion 150 by tapered surfaces 156 and 158, respectively. Thus, as can be best seen in the semi-schematic view in FIG. 6, the first envelope 51 when propelled by the driven roller 84*a* is directed to the previewing station located in the recessed portion 152 behind the preceding envelope 51*a* which is positioned in the viewing station 132*a*, which is predominantly located at the central portion 150 in front of the plane of recess 152. As will be noted in FIG. 6, the envelope 51*a*, when positioned in the viewing station 132*a*, extends rearwardly from the central portion and overlaps the next envelope 51 in a shingled effect and with its front edge engaging and temporarily restrained by the rotatable stop 140*a*. Release of the stop member by rotating out of the path of envelope 51*a* results in its passing to the next or reviewing station 134*a* where it assumes the position of envelope 51*b* and is restrained temporarily by stop 142*a*. When released, the envelope then assumes the position of envelope 51*c* in the buffering station 136*a* in a canted position with one end located against the recess wall 154 and restrained by stop means 143. It should be noted that while an equivalent stop means was not shown in the embodiment of FIG. 4, that device can also employ such stop means, if desired.

When the envelope is in the position of the buffering station 135*a* and has been released, the belt 120*a* will move it to the right into the nip of driven roller 160 and idler 162 for movement into the labeler module for application of a label serially printed in the printer module as will be explained hereinafter.

Referring once again to FIG. 6, it will be noted that a plurality of detector means are provided in spaced locations along the transport module. For example, detector 112 reports the presence or absence of an envelope in the viewing station 132*a*; detector 114 reports the presence or absence of an envelope in reviewing station 134*a*; detector 116 reports the presence or absence of an envelope in the buffering station 136*a*; and detector 118 reports the presence or absence of a envelope in the nip of feed rollers 160–162 at the entrance to the labeler module. The information reported by these detectors, which are commercially available in a wide variety of configurations, is fed to the program controlling the operation of the entire system. When a label has been prepared for a particular piece of mail the envelope is released from the buffering station and driven by rollers 160–162 to the labeler module for application of the label. The movement of belt 120, the stop means 140*a* and 142*a* are synchronized with the presence or absence of envelopes in their respective locales and additional envelopes are not introduced to the transport module 24*a* from the feeder module 22*a* until the detector 110*a* reports that the position at drive rollers 84*a* is empty and prepared to accept the next envelope from the stack 50. While only one such detector, namely 110, was mentioned in the first embodiment, shown in FIG. 4, it goes without saying that that embodiment must also employ suitable detection means to enhance its unified and synchronized operation.

This second embodiment, as seen in FIGS. 5 and 6, with its shingled arrangement in front of the operator, provides the following advantages, namely, a foreshortening of the length of the transporter module resulting in space saving; it increases productivity of the operator by reducing the time required for exchange of documents between the different positions of the stations; and a further increase in productivity is realized by sensing the back edge of the first document and reacting to the size of the documents presented for action by the operator.

By referring to FIG. 6, it will be noted that the stops 140*a* and 142*a* rotate clockwise to release the documents. When they return to the blocking position, the tip 146*a* of the second stop 142*a* will bear against the envelope 51*c* and cause it to move back into the canted position illustrated and align its front end for delivery to the nip of rollers 160–162 when it is released for further movement.

The transport module is described in detail for purposes of disclosing the operation of the system, however, more detailed information and coverage is included in a co-pending application filed concurrently with the present application, namely, Ser. No. 07/109,492, filed 10/16/87.

The next modules are physically interrelated by close proximity, namely, the labeler module 26 and the printer module 28, for purposes of discussion the labeler module 26 will be discussed in detail for the purpose of showing its relationship to other modules within the system while specific coverage is contemplated and claimed in a co-pending application filed concurrently with this application, Ser. No. filed 10/16/87. The printer module 28 will be discussed in general terms since it is discussed in greater detail and specifically claimed in a copending application filed concurrently with this application, Ser. No. 07/109,474, filed 10/16/87.

Referring now to FIGS. 7 through 12, the labeler module 26 requires a supply of labels disposed on a substrate in end to end fashion and with suitable means for driving the substrate or release means, i.e. the substrate being quickly releasable from the surface of the substrate under proper conditions, the label having a pressure sensitive adhesive on its reverse side facing the substrate. In the present device a label cassette 30 contains an elongated strip-like substrate 170 having a plurality of serially disposed apertures along each edge for engagement with suitable tractor drive mechanisms and adapted to carry the elongated labels 172 in end to end relationship and positioned between the tractor drive apertures. The substrate 170 is disposed in the cassette 30 in an edgewise fanfold arrangement, the cassette being provided with a curved endwall 174 to facilitate ease in feeding the fanfold substrate when it is laterally directed through a side aperture 176 that accepts guide means, such as a pair of spring urged wheels 178 and 180 to insure smooth feeding of the strip.

A tractor drive 182 is disposed laterally of aperture 176 and has a plurality of power driven pins 184 that are maintained in positive engagement with the holes of substrate 170 by a movable spring-urged gate 186. A detector means 188 is disposed adjacent to the tractor drive 182, for purposes best set forth hereinafter.

The strip 170 with the labels 172 pass over an idler roller 190 into engagement with the ink transferring roller 192 for striking by the print head 194 to transfer ink from roller 192 to the surface of the labels 172 facing the roller 192. Tension in the strip 170 is maintained by another spring loaded idler roller 196, while an ink supply for transfer roller 192 is maintained at the desired level by an impregnated ink roller 198 extending through aperture 200 in case 202 and maintained in contact with transfer roller 192 by means of spring means 204 acting on pivotable arm 206 on which the roller 198 and its case 202 are mounted. The specific details of ink transfer roller 192 and its relationship to print head 194 and ink roller 198 are set forth in a companion application to the present one, as set forth hereinabove.

After passing over idler pulley 196 the strip engages the label applicator drum 210. The drum 210 is best seen in enlarged plan view in FIG. 12; partial cross-section in FIG. 8 and with one detail being shown in FIG. 10; and includes cylindrical roller body 212 having a pair of counterbored cavities 214 at opposite ends. A plurality of headed bullet-nose pins 216 project outwardly through a like number of apertures communicating between the outer surface of roller body 212 and the inner cavities 214. In one embodiment of this drum the heads 218 of the pins 216 are slotted as at 220 and adapted to accept spring means 222. In the illustrated embodiment this constitutes a single spring steel wire ring, for the purpose of permitting spring urged retraction of the pins 216, as described hereinafter. The drum 210 is freely rotatably mounted by bushings 223 on a synchronously driven shaft 224 and connected to shaft 224 through a one way clutch means 226 which can be circumferentially adjusted by hand roller 228. The double row of pins 216 are spaced to accommodate the tractor holes in strip 170 normally positioned on opposite sides of the label 172 that is accommodated therebetween with the label being in direct contact with drum roller 212.

Figure 11:
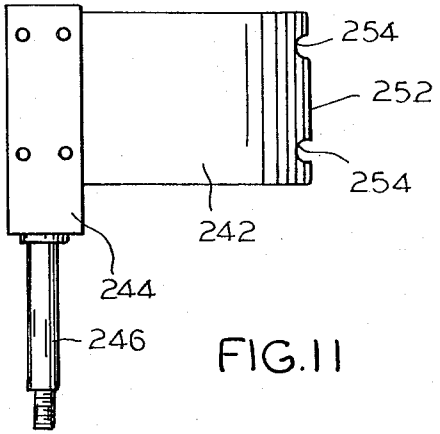
FIG. 11 is an elevational view of the direction controlling means for the separation of the label from the substrate or backing release tape.
Figure 11A:
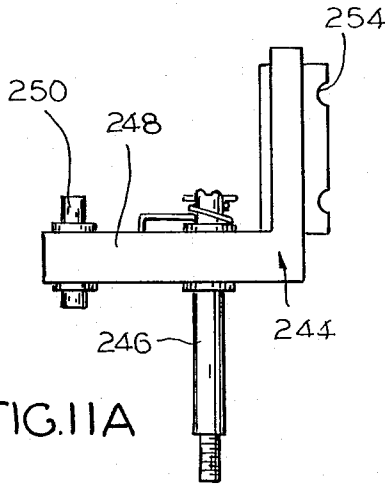
FIG. 11A is an elevational view of the device shown in FIG. 11 rotated 90° about the lower stud.
Figure 10:
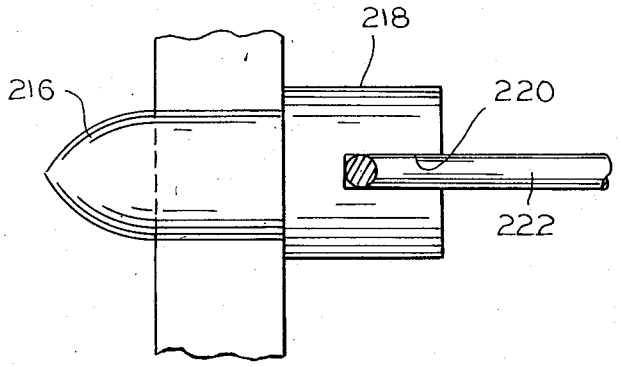
FIG. 10 is an enlarged elevational view in partial section showing the detail of on of the spring loaded fingers in the label applying drum.
Figure 7:
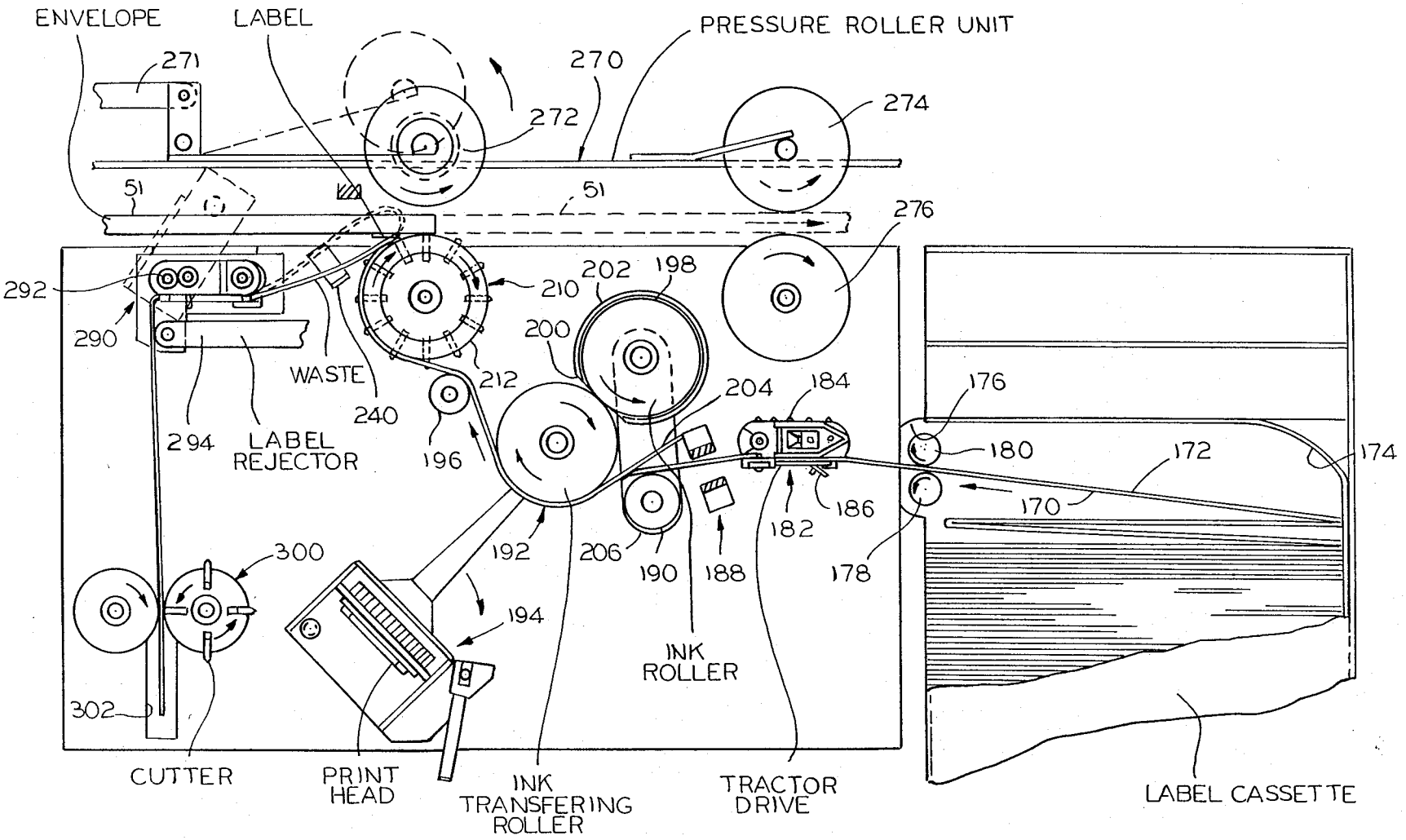
FIG. 7 is a plan view in partial section of the feeding of labels disposed in end-to-end fashion on a tractor driven tape from a label cassette past the printing station to the label applying station and with the label rejector and waste cutter means shown in plan view.
Figure 9:
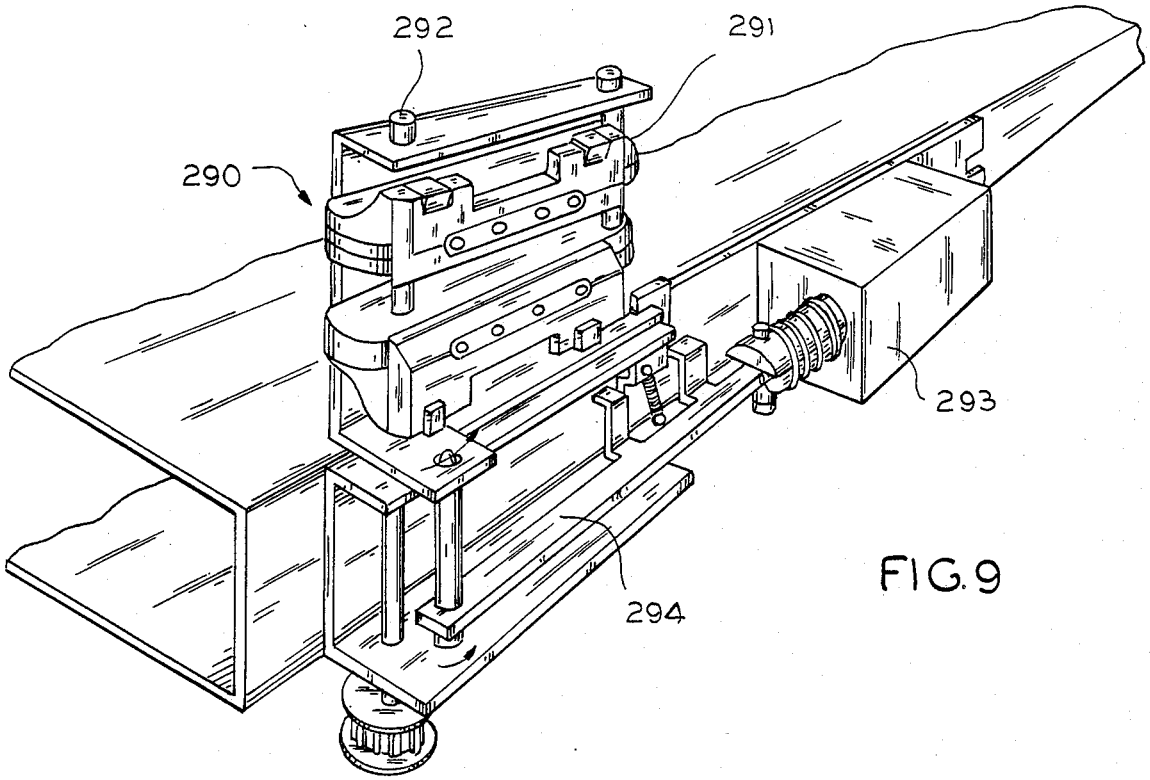
FIG. 9 is a perspective view in partial section of the label rejector means.
Figure 8:
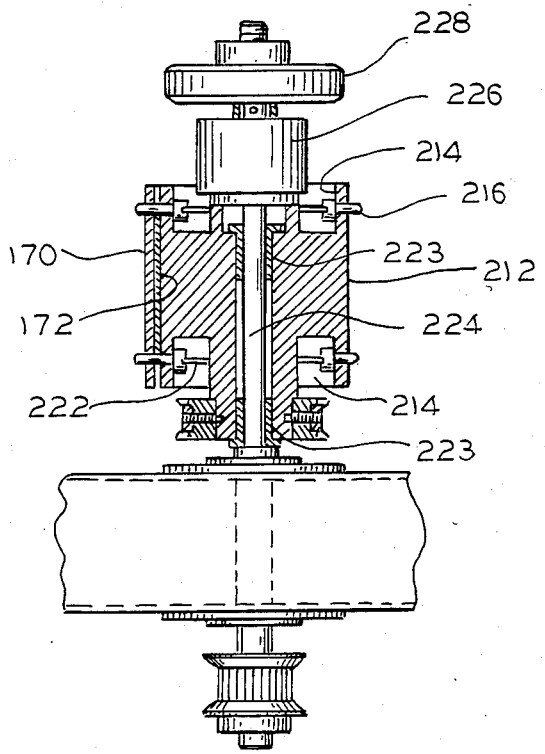
FIG. 8 is an elevational view in partial section showing the label applicator roller.
Figure 12:
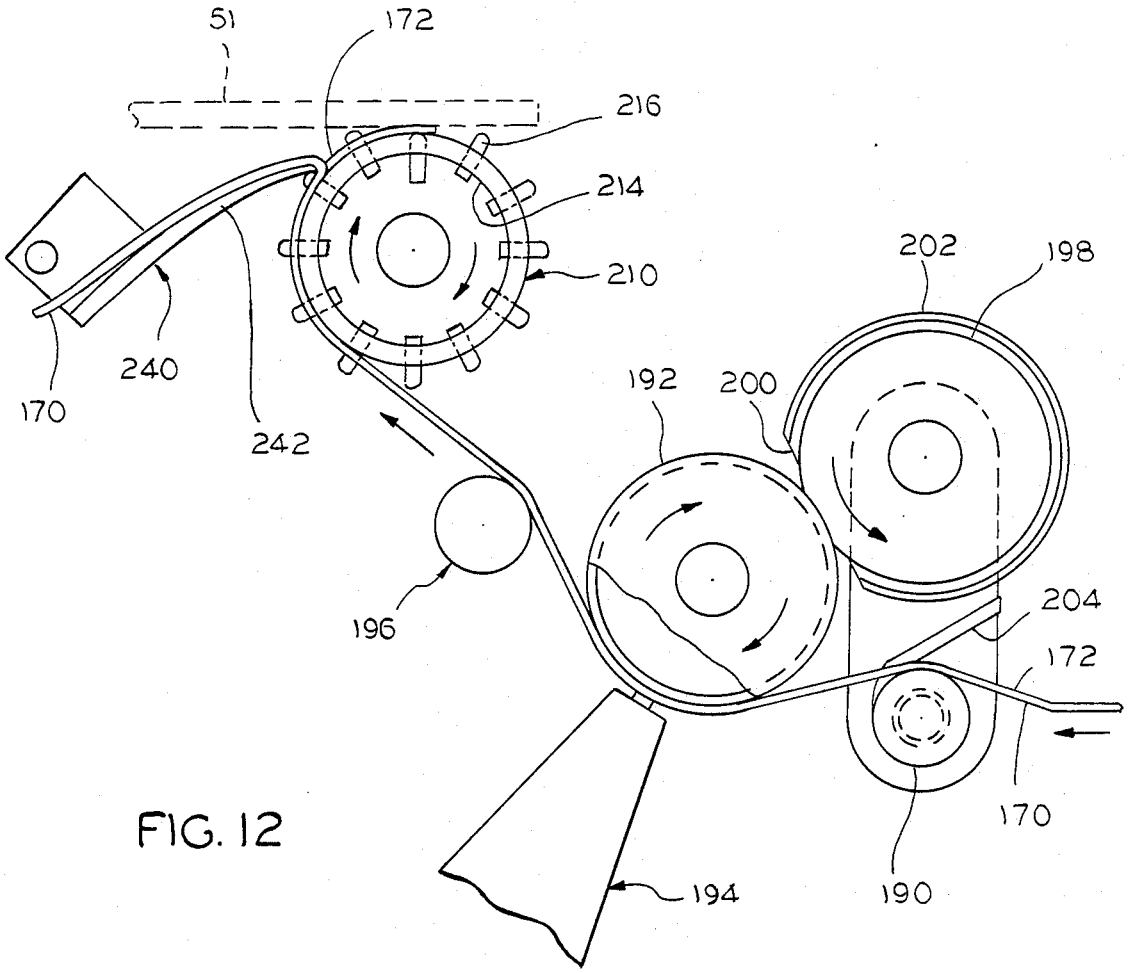
FIG. 12 is a schematic view in partial section showing the disposition of elements in the feed path of the substrate through the printing module and the labeler module, in enlarged format.

Positioned immediately adjacent to roller 212 in a generally tangential position is the label stripper assembly 240, which is best seen in FIGS. 11, 11A, and 12. The stripper includes a generally curved rectangular member 242 mounted on an L-shaped base assembly 244 having a spring loaded shaft 246 movable relative to the horizontal portion 248 of base 244. An index pin 250 extends upwardly from portion 248. The free extremity 252 of member 242 includes a pair of spaced clearance slots 254 which accept passage of the pins 216 when the drum 210 revolves. As best seen in the enlarged view in FIG. 12, the substrate 170 is engaged in its tractor drive apertures by the pins 216. When it reaches the extremity 252 of the stripper blade 242 it is reversed back upon itself and thereby automatically disengages itself from the label 172 with the latter continuing around the periphery of the drum 210. The envelope 51, shown in phantom, is fed tangentially onto the drum 210 with the envelope depressing the spring loaded pins 216 to bring its surface into intimate contact with the label 172. Such intimate contact is assured by the pressure roller unit 270 which includes a movable spring urged roller 272 and a second fixed spring urged roller 274 forming a nip with driven ejection roller 276 for deliverance of readdressed envelopes to the sorting and batching equipment 32.

When a rejection situation arises because of an error in input data, the detector 188 detects the trailing end of the erroneous label on the substrate, with the result being explained hereinafter. Immediately following the label stripper assembly 240 is a tractor driven label rejecter mechanism 290 consisting of a power tractor drive pivotable about pivot 292 when actuated by a solenoid (not shown) acting on arm 294. When an eject situation arises the detector 188 reports the trailing end of the particular erroneous label 172 on the substrate 170 and triggers the solenoid to pull on arm 294 (to the right in FIG. 7) to thereby move the tractor unit 290 about pivot 292 in a counterclockwise rotation as indicated by the arrow which disengages the tractor drive causing a lack of tension in the substrate which causes it to form a loose loop, as seen in phantom. Additionally, the detector triggers the activation of a second solenoid (not shown) connected to the arm 271 which is moved to the left causing the backup roller 272 to move in a counterclockwise direction, as indicated by the arrow and to move the roller away from the back side of envelope 51, because the label applicator stops when not applying a label, and therefore pressure of the back-up roller must be removed. Otherwise, the envelope will be slowed up or stopped due to pressure of the back-up roller 272. Further the movement of back-up roller 272 to the out of engagement position permits the formation of the enlarged loop when the tension on the substrate is removed and thereby prevents the peeling of the label from the substrate that normally occurs when it is sharply bent under tension around the end of the blade-like member 252 found in the label stripper assembly 240. In the embodiment shown in FIG. 7 the label stripper assembly 240 is shown generally fixed in its tangential relationship to drum 210. Coser examination of the details shown in FIGS. 11 and 11A reveal that the stripper blade 242 is substantially identical but the assembly 244 includes the spring-loaded stud 246 and guide pin 250. This configuration will permit movement of the free end 252 by rotation about the pivot point formed by the stud 246. By movement in a counterclockwise direction, as viewed in FIG. 7, the removal of the free end 252 from close proximity to the tangent to the drum 210 will permit release of the tension in substrate 170 and the quicker formation of the enlarged loop that prevents peeling of the label from the substrate by removal of tension therefrom. Thus, this removal of tension prevents the application of a particular label to an envelope and the substrate material and the attached label moves to the scrap cutter 300 for disposition and deposit through slot 302 into a waste container, not shown.

After the disposal of the rejected label to scrap, or at least beyond the applicating roller 210, all of the solenoids (not shown) which are connected to arms 271 and 294, or means for actuating movement of the stripper assembly 240, are all returned to a normal or initial position thereby increasing tension on the substrate 170 and preparing the equipment and system for further application of labels to envelopes. The movement of the label in the same direction as the envelope increases the efficiency of this machine and insures a rapid and positive means for application of the serially produced labels.

Other means for applying labels to envelopes or packages will be apparent to those skilled in the art and mechanical equivalents to those indicated above will be called to mind, however, it felt that this invention should be limited only by the claims attached hereto.

I claim:

1. A computer enhanced document forwarding system including means for feeding individual generally flat documents from a generally horizontally disposed edge stack of documents; transporter means for accepting desirably disposed end to end individual documents one at a time and sequentially moving each document to at least one station for observation by an operator; electronic information storage means with an interconnected input and retrieval means disposed adjacent to said at least one observation means station; means providing a supply of self-adhering labels disposed in end to end fashion; an electronically controlled printer wherein the labels pick up ink in predetermined array, and continuous label applying means for serially applying corrective labels to serially disposed documents with both labels and documents moving in the same direction, thereby carrying corrective information supplied by said storage means to individual pieces of incorrectly designated documents, said horizontal feeder means for feeding documents including means for fanning said documents to assist in the sequential delivery of a single document to said transporter, said horizontal feeder means further including a generally horizontally disposed receptacle having an elongated substantially planar base and at least one side restraining means adapted to accept a plurality of documents each having the lower one edge engaging said base in generally transverse vertically oriented document disposition, means providing a bias of force against the stack of said plurality of documents, said fanning means further including a plurality of movable means exposed in said planar base and adapted to contact said lower document edge at spaced points and said movable means having differing velocities of motion in the same direction, said spaced movable means having a relatively progressive increase in velocity as measured transversely from one edge of said base to the opposite edge.

2. A system of the type claimed in claim 1 wherein said spaced plurality of belt-like members each have a progressively increased velocity greater than the velocity of the next adjacent belt-like member when moving along a transverse viewing line of sight relative to said base.

3. A system of the type claimed in claim 2 wherein said beltlike members utilize a single power source.

4. A system of the type claimed in claim 3 wherein said beltlike members are driven by a plurality of driving drums having differing diameters.

5. A system of the type claimed in claim 4 wherein said driving drums are arranged in an ever increasing order of size and disposed in spaced relation along shaft means interconnected with a common power source.

6. A system of the type claimed in claim 1 wherein said feeder includes an elongated generally planar base, a plurality of spaced generally parallel slots extending along the length of said base, an equal number belt means disposed in said slots and moving at increasing rates of speed such that their relative velocities would be expressed as follows, namely, V1,V2.....Vn, whereby said documents standing on their edge on said base will tend to cant from end to end and be angularly disposed transversely of said base, the end of said document edge contiguous to the belt having the highest velocity will tend to fan away from said stack and present an end spaced from said stack for easy separation therefrom by suitable means to move the document out of the stack onto the transporter.

7. A system of the type claimed in claim 6 wherein said feeder includes spring loaded means in the form of a movable back plate for moving the stack of documents from one end of said base toward the other end as documents are removed and transferred to the transporter, pivotable angled plate means confronting said stack at said other end of said base, pressure responsive control means adapted to turn off the power source driving said belts when the pressure of said stack against said pivoted plate means exceeds a predetermined level.

8. A system of the type claimed in claim 7 wherein said pivotable plate is spring loaded and adapted to rotate about a pivot adjacent one end of said pivotable plate and move against said spring when confronted by excessive pressure from said stack, switch means activated by said moved pivotable plate and stopping motion by said belts until said excessive pressure is relieved by removal of documents from said stack.

9. A system of the type claimed in claim 7 wherein said feeder includes a feed wheel means adapted to engage the first document in said stack adjacent said angled plate and cause said first document to move laterally away from said feeder base, said feed wheel means including means for controlling its position of engagement with the first document in said stack of documents.

10. A system of the type claimed in claim 9 wherein said feeder includes a first driven roller and a spring loaded back-up roller in opposition thereto and adapted to accept and move said first document away from said feeder when said feeder roller initiates movement of said first document away from said feeder towards said first driven roller.

11. A system of the type claimed in claim 10 wherein said feeder includes a second driven roller and a back-up roller in opposition thereto spaced from and aligned with said first driven roller, said second driven roller having a higher speed than said first driven roller, the latter including an override clutch means, whereby said second driven roller will pull the document faster than its movement through the first driven roller and activate the override clutch means before damaging said document.

12. A system of the type claimed in claim 11 wherein said feeder includes detection means for determining the presence or absence of document means between said first and said second pairs of rollers, said detection means controlling the feed wheel means between an engaged and a disengaged position to thereby prevent inadvertent jams by having more than one document in transit between the pairs of driven and back-up rollers that lead from the feeder means and the transporter means.

13. A system of the type claimed in claim 7 wherein said detection means includes a path interrupting photo cell, said feed wheel means being carried by a spring loaded power activated pivot arm, circuitry including said detection means that energized said power for activating said arm whereby said feed wheel means is disengaged until said document clears said detection means whereby said power is deenergized and said feed wheel means engages and moves the next document.

14. A system of the type claimed in claim 13 wherein said feed wheel means and said first and second driven rollers are powered by the same motive force means.

15. A system of the type claimed in claim 14 wherein said activating pivot arm pivots about the axis of the first driven roller.

16. A system of the type claimed in claim 11 wherein said feed wheel means, said first driven roller and said second driven roller each include means for contacting said document at vertically spaced points to thereby ensure vertical stability of said documents during passage between said feeder and said transporter means.

17. A system of the type claimed in claim 16 wherein each of said feed wheel means, said first driven roller and said second driven roller and back-up rollers, if any, include two spaced rollers on a common axis to thereby contact and grip said documents at spaced points.

18. A system of the type claimed in claim 1 including transporter means having a combination viewing and transport module including means for accepting a document from said feeding means, means for moving said document in a sequential fashion through at least one station which is visible to an operator controlling the said system, means for retaining a document at a particular station for a time interval adequate for the operator to react to the indicia means on the document and means for activating the release of said retaining means, said viewing and transport module including a previewing station, a viewing station, a reviewing station and a buffering station, said system further including means for feeding an abbreviated version of the indicia means visible on said document in said viewing station into said electronic storage means which means compares it with information available in said storage means and provides a retrieval of at least one piece of information for use in correction of said indicia means on said document, if there is more than one piece of information which fits the parameters of said abbreviated version input then said operator is supplied with said multiple information and means are provided for a predetermined time interval for choosing the correct information, releasing said document from said reviewing station and moving same to said buffering station.

19. A system of the type set forth in claim 18 wherein said information is provided in a visual display.

20. A system of the type set forth in claim 18 wherein said information is provided in an audible display.

21. A system of the type set forth in claim 19 wherein said display is on a CRT and interconnected with a micro-computer and keyboard which said operator can manipulate to input and receive data therefrom.

22. A system of the type set forth in claim 18 wherein said stations are linearly oriented.

23. A system of the forth in claim 18 wherein said stations are staggered so that at least portions of adjacent ones of said serially displayed documents overlap one another thereby diminishing the overall length of said transport module.

24. A system of the type set forth in claim 23 wherein said transporter module has a generally horizontally disposed longitudinal longitudinal axis, the path followed by a document into and within said previewing station is skewed relative to said longitudinal axis, means within said previewing station for correcting the skewed condition of said document a it is leaving said previewing station for entry into said viewing station.

25. A system of the type set forth in claim 24 wherein said transporter module includes an elongated wall means having a central median wall element disposed substantially on said longitudinal axis and defining a substantial portion of both the viewing and reviewing stations, means disposed intermediate the lateral extremities of said median wall defining the general limits of said two stations, the portions of said elongated wall means defining said previewing and buffer stations being spaced rearwardly from said central median wall element to form recessed cavities at each end of said elongated wall means, cam wall means interconnecting said median wall element with said recessed cavities, said means defining the limits of said viewing and reviewing stations being control means for controllably retaining and releasing documents serially passing through said stations, said means for moving said documents being capable of providing motive power on both a continuous and an intermittent basis.

26. A system of the type set forth in claim 25 wherein said means for moving said documents includes a movable conveyor means movable along said longitudinal axis, and said control means including means projecting into the path followed by said document as carried by said conveyor means to retain an individual document at a predetermined station for examination and review.

27. A system of the type set forth in claim 26 wherein at least two of said control means are connected together for coordinated action.

28. A system of the type set forth in claim 27 wherein said control means are mechanical gates that are physically interposed in the path of the documents moving on said conveyor means.

29. A system of the type set forth in claim 28 wherein said conveyor means is a horizontally disposed belt means capable of supporting said document means and movable at least a predetermined distance to carry said document from station to station when said gates are removed from the path of the documents.

30. A system of the type set forth in claim 29 wherein said belt means is continuously moving and frictionally slips under the said documents when they are restrained by said gates and moves said documents when the gates are removed to a retracted position relative to the path of said documents.

31. A system of the type set forth in claim 30 wherein said buffer station is recessed rearwardly from said median wall and interconnected therewith by an abrupt cam means, said control means being positioned intermediate the lateral extremities of said buffer station and said control means acting in a dual capacity of retaining one document in the reviewing station and also pushing the serially previous document that has left the reviewing station into a skewed position within the buffering station when said document is restrained against movement along the longitudinal axis by the final control means in the transporter module preceding entry of the document from the buffering station into the said printer-labeler module.

32. A system of the type set forth in claim 1 wherein said printer-labeler module includes storage means for retaining and making readily available a supply of initially blank label means in end-to-end disposition; drive means for controlling movement of said label supply; print means capable of accepting discrete information from said storage means and translating said information to printed matter on said label, means for applying discrete printed labels in selected order to selected documents coming from said buffering station, said lables being individual labels affixed to a continuous strip of backing material from which they can be readily stripped, said label applying means includes a driving cylinder having a plurality of retractable pin members that coincide and engage with suitable drive means on said backing material strip, stripper means and secondary driving means disposed to cause an abrupt change in direction of said backing material relative to labels affixed thereto whereby said lables are stripped from said backing material, said document path being immediately adjacent to said stripper means and documents in said path being each positioned to accept a label stripped from said backing materials, and means for insuring intimate contact between each said label and document.

33. A system of the type set forth in claim 1 wherein said printer includes an ink-transfer roller and a matrix printing head having impression pins which are adapted to push the labels from their back side to cause the front surface of the labels to pick up ink from said transfer roller in predetermined symbol array.

34. A system of the type set forth in claims 33 wherein said transfer roller carries droplets of ink and said dot matrix impression means is driven by said stored memory and said lables are of the self-adhering variety so that as they are stripped off of a non-sticking medium they will be readily accepted on said documents in a serial fashion.

* * * * *